US006735928B2

(12) United States Patent
Kondo et al.

(10) Patent No.: US 6,735,928 B2
(45) Date of Patent: May 18, 2004

(54) BAGGING AND PACKAGING MACHINE CAPABLE OF FILLING A PROPER QUANTITY OF INERT GAS INTO BAGS

(75) Inventors: Masashi Kondo, Shiga (JP); Ryoichi Sato, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 0 days.

(21) Appl. No.: 09/748,907

(22) Filed: Dec. 27, 2000

(65) Prior Publication Data

US 2001/0005974 A1 Jul. 5, 2001

(30) Foreign Application Priority Data

Dec. 27, 1999 (JP) ..... 11-370072

(51) Int. Cl.[7] ..... B65B 57/10; B65B 57/16

(52) U.S. Cl. ..... 53/508; 53/510; 53/511; 53/433; 53/551; 53/552; 53/575

(58) Field of Search ..... 53/510, 550, 551, 53/512, 575, 133

(56) References Cited

U.S. PATENT DOCUMENTS

| | | | | | |
|---|---|---|---|---|---|
| 3,579,945 | A | | 5/1971 | Buchner et al. | |
| 3,664,086 | A | * | 5/1972 | James et al. | 141/4 |
| 3,788,368 | A | * | 1/1974 | Geng et al. | 141/67 |
| 3,789,888 | A | * | 2/1974 | James et al. | 141/4 |
| 3,860,047 | A | * | 1/1975 | Finkelmeier et al. | 141/104 |
| 3,948,015 | A | | 4/1976 | Lerner | |
| 4,636,391 | A | * | 1/1987 | Pike | 426/106 |
| 4,769,974 | A | * | 9/1988 | Davis | 53/433 |
| 4,964,259 | A | * | 10/1990 | Ylvisaker et al. | 53/374.8 |
| 5,060,514 | A | * | 10/1991 | Aylsworth | 73/24.01 |
| 5,452,563 | A | * | 9/1995 | Marano et al. | 53/432 |
| 5,678,388 | A | * | 10/1997 | Weder | 53/253 |
| 5,768,859 | A | * | 6/1998 | Goglio | 426/397 |
| 5,822,951 | A | | 10/1998 | Rosik | |
| 5,961,000 | A | * | 10/1999 | Sanfilippo et al. | 141/47 |
| 6,032,438 | A | * | 3/2000 | Sanfilippo et al. | 141/129 |
| 6,202,388 | B1 | * | 3/2001 | Sanfilippo et al. | 53/432 |
| 6,220,000 | B1 | * | 4/2001 | Kammler et al. | 53/508 |
| 2001/0005974 | A1 | * | 7/2001 | Kondo et al. | 53/508 |

FOREIGN PATENT DOCUMENTS

| | | | | |
|---|---|---|---|---|
| DE | 2/503547 | | 8/1976 | |
| JP | 10/053217 | * | 2/1998 | B65B/31/04 |

* cited by examiner

*Primary Examiner*—Rinaldi I. Rada
*Assistant Examiner*—Gloria R Weeks
(74) *Attorney, Agent, or Firm*—Hogan & Hartson, LLP

(57) ABSTRACT

A bagging and packaging machine for forming a bag from a strip of bag material and introducing an article into the bag includes a gas supply unit for supplying an inert gas into the bag to substitute for air contained in the bag and a gas supply control means for controlling supply of the inert gas by the gas supply means into the bag. The bagging and packaging machine is designed to allow the inert gas to be supplied under high pressure at a flow rate sufficient to increase the gas replacement rate in the bag when the machine is started, to be supplied under low pressure at a flow rate lower than the high pressure flow rate during a bagging and packaging operation subsequent to the start of the machine. Should the machine is temporarily brought to a halt, the length of time T passing from the timing at which the machine is temporarily brought to a halt is counted by a timer without the supply of the inert gas being interrupted, so that the supply of the inert gas can be interrupted at a timing the counted length of time exceeds a low pressure gas supply time T2. In this way, without the bag being bitten during bagging and/or the bagging and packaging speed being lowered, not only can the inert gas be sufficiently filled in the bag to achieve a high gas replacement rate, but the amount of the inert gas supplied can also be suppressed.

14 Claims, 9 Drawing Sheets

BAGGING AND PACKAGING MACHINE CAPABLE OF FILLING A PROPER QUANTITY OF INERT GAS INTO BAGS

BACKGROUND OF THE INVENTION

1. Field of the Invention

The present invention generally relates to the art of packaging and, more particularly to a bagging and packaging machine for successively forming bags from a strip of bag material and subsequently packaging an article into each of the bags.

2. Description of the Prior Art

In general, the bagging and packaging machine for successively producing bagged products by forming bags from a strip of bag material and subsequently packaging an article into each of the bag undergoes a process of forming the strip of bag material, supplied to a bag former, into a tubular form by means of the bag former by overlapping opposite longitudinal side edges with each other; fusion bonding, by means of a longitudinal sealing unit, the overlapped longitudinal side edges of the tubular strip of bag material in a direction longitudinally thereof at an outer surface of a front wall of an article introducing tube member forming a part of the bag former and, then, fusion bonding the tubular strip of bag material in a direction perpendicular to the longitudinal sense of the tubular strip of bag material to form a bottom seal by means of a transverse sealing unit; after an article has been introduced into the tubular strip of bag material through the article introducing tube member, fusion bonding an upper portion of the tubular strip of bag material by means of the transverse sealing unit to form an upper seal to seal the article within the tubular strip of bag material; and finally cutting the tubular strip of bag material along the upper seal to thereby to produce a bagged product containing the article sealed within the bag.

In the practice of this process, where the article filled in each of the successively formed bags is food material, it is a general practice to form the upper seal in the bag after an inert gas such as, for example, nitrogen gas or argon gas has been substituted for air contained in the bag containing the article therein.

The gas replacement method used in conjunction with this type of bagging and packaging machine for substituting the inert gas for the air within each of the bags includes, where a high speed handling is desired to be enhanced, supplying either continuously or intermittently of the inert gas at a predetermined flow rate into each of the bags simultaneously with filling of the article into the respective bag, to thereby purge the air within such bag.

However, in the practice of the above discussed gas replacement method, although a relatively high rate of replacement with the inert gas can be secured as a large flow of the inert gas is supplied into each of the bags, it has been found that since the amount of the inert gas supplied from the gas supply unit is relatively large, the cost of making the bagged products tends to increase correspondingly.

In addition to the foregoing problem, another problem has been found in that with the above discussed gas replacement method, to maintain the rate of gas replacement at a relatively high level, the flow velocity of the inert gas has to be increased so that the amount of the inert gas supplied per unitary time can be increased. However, increase of the gas flow velocity tends to result in that the inert gas is vigorously introduced into the bag and, consequently, some of items of the article to be bagged are blown upwardly within the bag and/or an introduction of the article towards the bottom of the bag is hampered. In such case, when the upper seal is to be formed in the filled bag by means of the transverse sealing unit, some of items of the article which have been blown upwards within the bag or which have been retarded to reach the bottom of the bag are often "bitten" by the transverse sealing unit, resulting in an unacceptably defective bagged product.

In an attempt to substantially eliminate the above discussed problems, the Japanese Laid-open Patent Publication No. 10-53217, for example, discloses a bagging and packaging machine in which the flow of the inert gas is varied at each of a plurality of processing stages of one cycle of forming the tubular form from the strip of the bag material, filling the article into the resultant tubular strip of the bag material and sealing the filled tubular strip with the article therein.

In the machine disclosed in the above described Japanese publication, during a period in which the article is supplied from above through the tube member into the tubular strip of the bag material then formed into an open-topped bag, the inert gas is supplied into the tubular form at a first flow rate of a value not so high to avoid upward blow-up of some of the items of the articles within the tubular form and also to avoid disturbance to a smooth introduction of the items of the article down to the bottom of the tubular form; and a period subsequent to completion of the filling of the article into the tubular form, the inert gas is supplied into the filled tubular form at a second flow rate higher than the first flow rate. The second flow rate is so chosen as to accomplish an immediate substitution of the inert gas for the air stagnating in an upper region of the interior of the tubular form while avoiding the blow-up of some of the items of the article within the tubular form.

Accordingly, the possibility can be minimized in which when the upper portion of the tubular form having the articles filled therein is to be sealed, some of the items of the article which have been blown up within the tubular form and have been retarded from reaching the bottom of the tubular form may be bitten by the sealing unit. Also, any possible undesirable increase of the amount of the inert gas supplied from the gas supply unit into the tubular form can be suppressed.

It is, however, to be noted that the bagging and packaging machine disclosed in the above discussed Japanese publication employs the inert gas supply system in which the different flow rates of the inert gas are employed for each of the processing stages of one packaging cycle to thereby substantially eliminate the above discussed problems. Hence, so long as the bagging and packaging machine is continuously run without being halted, the gas replacement rate at a relatively high level can be secured and the amount of the inert gas supplied from the gas supply unit can be minimized.

However, other than the occasion that the prior art bagging and packaging machine is halted manually by the attendant worker when the bagging and packaging operation is desired to be interrupted, it often occurs that the bagging and packaging machine is halted or temporarily interrupted by some reason. In such case, the gas supply unit incorporated in the bagging and packaging machine will continue supplying the inert gas regardless of the operating state (i.e., halted or interrupted) of the bagging and packaging machine, and therefore, the amount of the inert gas supplied, that is, the usage of the inert gas tends to be unnecessarily increased.

Also, with the prior art bagging and packaging machine of the type discussed above, the attendant worker has to bring the inert gas supply unit into inoperative position in the event of the machine being halted or interrupted temporarily, and to reopen the supply of the inert gas in the event of the machine resuming a normal operating condition. It has, however, been found that when and after the machine is resumed to the normal operating condition, a relatively long time is required for the flow rate of the inert gas being supplied to be stabilized at a predetermined value and, as a result, enhancement of the bagging and packaging operation at a high speed tends to be hampered and/or the gas replacement rate tends to be lowered.

SUMMARY OF THE INVENTION

The present invention pertains to the bagging and packaging machine of a type wherein the gas replacement takes place and aims at solving incompatible problems of attaining a relatively high gas replacement rate by sufficiently supplying the inert gas with no possibility of some of the items of the article being bitten at the time of sealing the bag and also with no possibility of the handling speed of the machine being lowered, and of minimizing the amount of the inert gas supplied from the gas supply unit.

In order to accomplish the foregoing objective of the present invention, the bagging and packaging machine in accordance with the present invention is so designed and so structured as follows.

In order to accomplish the foregoing object of the present invention, there is provided in accordance with a first aspect of the present invention, a bagging and packaging machine for forming a bag from a strip of bag material and introducing an article into the bag, which includes a gas supply means for supplying an inert gas into the bag to substitute for air contained in the bag, and a first gas supply control means for controlling supply of the inert gas by the gas supply means into the bag. The first gas supply control means is operable to effect supply of the inert gas into the bag at a first flow rate for a predetermined length of time subsequent to start of operation of the bagging and packaging machine to thereby increase a gas replacement rate and at a second flow rate lower than the first flow rate subsequent to elapse of the predetermined length of time, such that an amount of the inert gas consumed within the bag is counterbalanced with an amount of the inert gas supplied into the bag.

It is to be noted that the term "amount of the inert gas consumed" referred to above and hereinafter is intended to means the amount of the inert gas filled into the bag and is retained within the bag after the bag has been completely sealed. Also, the term "amount of the inert gas supplied into the bag" referred to above and hereinafter is intended to means the amount of the inert gas supplied by the gas supply means with respect to the single bag. Again, the term "counterbalanced with" referred to above and hereinafter is to be understood interchangeable with "equalized to".

According to the foregoing structure, the amount of the inert gas supplied by the gas supply means is at first set to a first flow rate in order to increase the gas replacement rate within the bag and, thereafter, set to a second flow rate lower than the first flow rate so that the amount of the inert gas consumed within the bag can be counterbalanced with, that is, equalized to the amount of the inert gas supplied into the bag. Accordingly, without the gas replacement rate within the bag being lowered, the amount of the inert gas supplied unnecessarily can advantageously suppressed to avoid an unnecessary increase of the amount of the gas used. Also, since the second flow rate is such as to avoid any undesirable blow-up of some of the articles within the bag, the supply of the inert gas at the second flow rate is effective to avoid any possible biting of the bag during a sealing operation of the bag with the articles filled therein, thereby minimizing production of unacceptable bagged products. In addition, since the first flow rate is chosen to be higher than the second flow rate, the inert gas can be filled at a high speed into the bag, thereby facilitating a bagging and packaging operation.

Preferably, the first gas supply control means may continue supply of the inert gas into the bag for a second predetermined length of time subsequent to a temporary halt of the bagging and packaging machine, in a quantity sufficient to avoid reduction of the gas replacement rate within the bag.

In accordance with a second aspect of the present invention, there is also provided a bagging and packaging machine for forming a bag from a strip of bag material and introducing an article into the bag, which includes a gas supply means for supplying an inert gas into the bag to substitute for air contained in the bag, and a first gas supply control means for controlling supply of the inert gas by the gas supply means into the bag. The first gas supply control means is operable to continue the supply of the inert gas into the bag for a second predetermined length of time subsequent to a temporary halt of the bagging and packaging machine, in a quantity sufficient to avoid reduction of the gas replacement rate within the bag.

By way of example, when in the event that the bagging and packaging machine is temporarily brought to a halt with the bagging and packaging operation consequently interrupted, the supply of the inert gas into the bag being filled with the article to be bagged is interrupted, the prior art bagging and packaging machine involves such a problem that the gas replacement rate within the bag decreases with passage of time subsequent to the interruption of the supply of the inert gas. However, according to the present invention, the supply of the inert gas is continued for the predetermined length of time even after the bagging and packaging machine is brought to a halt to thereby avoid any possible reduction of the gas replacement rate. Accordingly, when the bagging and packaging machine once halted resumes its normal operation within a predetermined length of time subsequent to the timing at which the bagging and packaging machine is brought to a halt, a relatively high gas replacement rate can be attained, making it possible to enhance the bagging and packaging operation at a high speed. Also, since the supply of the inert gas is interrupted after a predetermined length of time, the amount of the inert gas used by the gas supply means will not increase unnecessarily.

Furthermore, the present invention in accordance with a third aspect thereof provides a bagging and packaging machine for forming a bag from a strip of bag material and introducing an article into the bag, which includes a gas supply means for supplying an inert gas into the bag to substitute for air contained in the bag, an oxygen detecting means for detecting a state of oxygen remaining within the bag, and a second gas supply control means for controlling supply of the inert gas by the gas supply means into the bag. The second gas supply control means is operable to control the supply of the inert gas into the bag in dependence on the state of the remaining oxygen detected by the oxygen detecting means.

According to the third aspect of the present invention, since the second gas supply control means controls the state of supply of the inert gas based on the state of oxygen remaining within the bag detected by the oxygen detecting means, in the event that, for example, the oxygen detecting means detects an increase of the oxygen remaining rate, the amount of the inert gas supplied from the gas supply means can be adjusted by the second gas supply control means. Accordingly, bagged products each including a bag attaining a high gas replacement rate can be manufactured conveniently.

Preferably, the bagging and packaging machine may further include a warning means for issuing an alarm in the event that a rate of the remaining oxygen detected by the oxygen detecting means exceeds a predetermined value.

The use of the warning means is particularly advantageous in that since when the oxygen remaining rate increases, the warning means can issue an alarm, the attendant worker can easily be advised of increase of the oxygen remaining rate within the bag being formed by the bagging and packaging machine and it is therefore possible to avoid the possibility of a continued production of products having a high oxygen remaining rate.

Also, preferably, the bagging and packaging machine may further include a first storage means for storing an oxygen remaining rate necessary for each of a plurality of kinds of the articles to be bagged.

It is to be noted that the term "necessary oxygen remaining rate" referred herein is intended to means the maximum acceptable amount of oxygen left within the bag and is compatible with a threshold value of the oxygen remaining rate with which the bagged products can be shipped to the market.

Specifically, where the articles to be bagged are potato chips or chocolates or the like, if the first storage means is used to store the flow rate of the inert gas and others based on the shape and the weight thereof, at the time the bagging and packaging operation is to be initiated the bagging and packaging operation can be started by reading out from the first storage means the flow rate of the inert gas appropriate to the bag being filled with the articles. Accordingly, not only can a job of setting the flow rate of the inert gas and others advantageously be simplified, but the hour required to perform the job can also be reduced, thereby enabling the bagging and packaging operation to be performed efficiently. Also, since the amount of the inert gas to be filled in the bag is sufficient if coordinated with the characteristics of the bagged product, the amount of the inert gas which would be otherwise supplied unnecessarily can be suppressed.

Again preferably, the bagging and packaging machine may further include a display means for providing a visual indication of a status of supply of the inert gas from the gas supply means.

The use of the display means for providing the visual indication of the state of the inert gas being supplied from the gas supply means is particularly advantageous in that the attendant worker can visually grape the state of the inert gas being supplied such as the amount of the inert gas remaining in the gas supply means easily and, therefore, he or she knowing how much the inert gas remains in the gas supply means can launch a job of refilling the inert gas prior to the entire amount of the inert gas being consumed. Accordingly, the hour required to complete such a job can be reduced, making it possible for the bagging and packaging machine to perform the bagging and packaging operation efficiently.

The bagging and packaging machine may further include a second storage means for storing a status of supply of the inert gas from the gas supply means or an oxygen remaining rate during operation of the bagging and packaging machine.

According to this structure, the second storage means can store the state of supply of the inert gas from the gas supply means during the operation of the bagging and packaging machine. Therefore, in the event of a trouble occurring in replacement of the air in the bag with the inert gas during the bagging and packaging operation, the state of supply of the inert gas at the time of occurrence of the trouble can be called for from the second storage means so that information necessary to identify a cause of the trouble can be obtained. It is also possible to ascertain whether or not the gas replacement within the bag is properly performed.

BRIEF DESCRIPTION OF THE DRAWINGS

In any event, the present invention will become more clearly understood from the following description of a preferred embodiment thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

With reference to the accompanying drawings, the present invention will be described in detail in conjunction with a preferred embodiment thereof that is taken only for the purpose of illustration.

Figure 1:
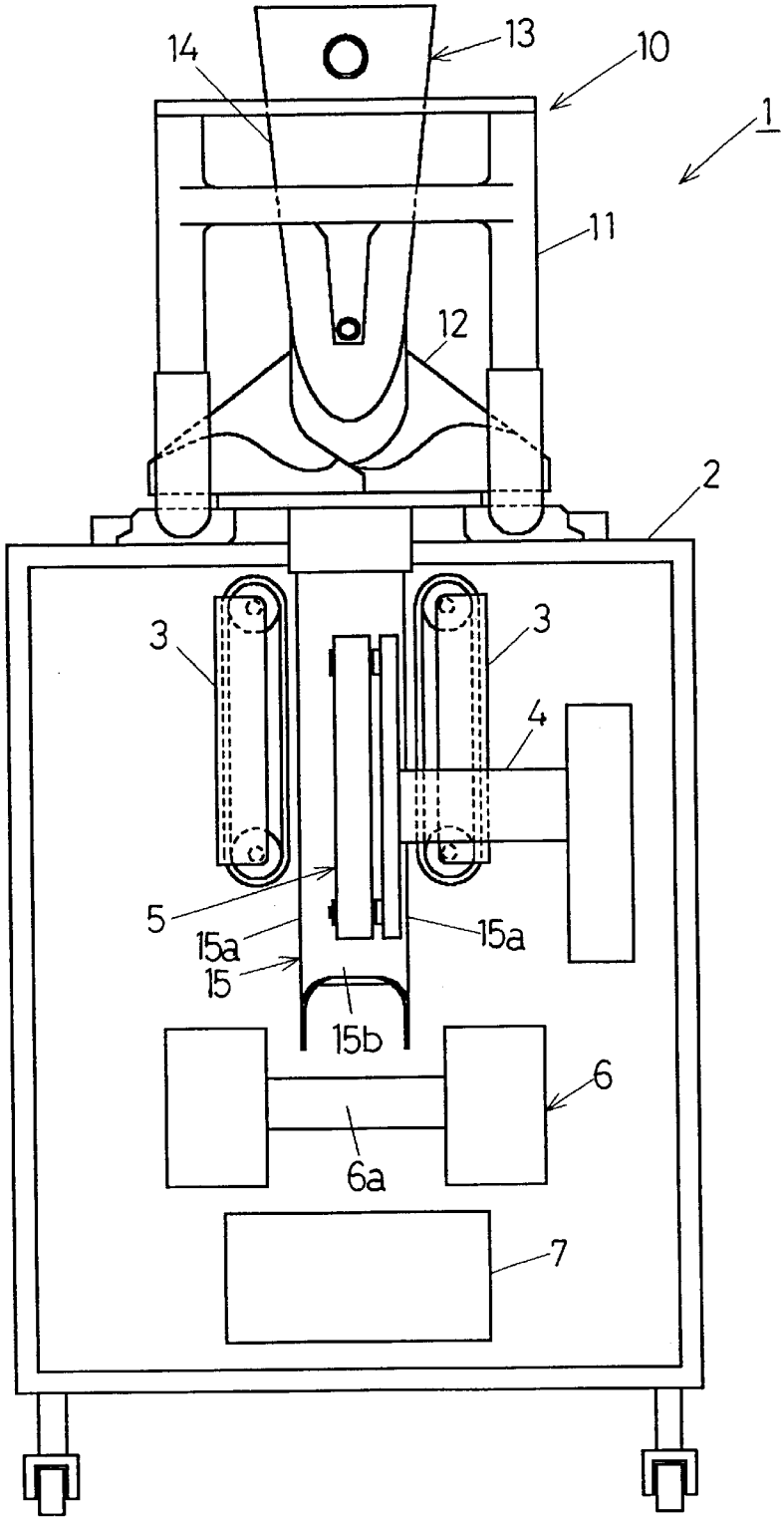
FIG. 1 is a schematic front elevational view a bagging and packaging machine according to a preferred embodiment of the present invention.

Referring first to FIG. 1, the bagging and packaging machine 1 according to the present invention includes a base framework 2, a roll support (not shown) mounted on a rear top portion of the base framework 2 for rotatably supporting a roll of packaging material and a bag former 10 mounted on a front top portion of the base framework 2.

Figure 2:
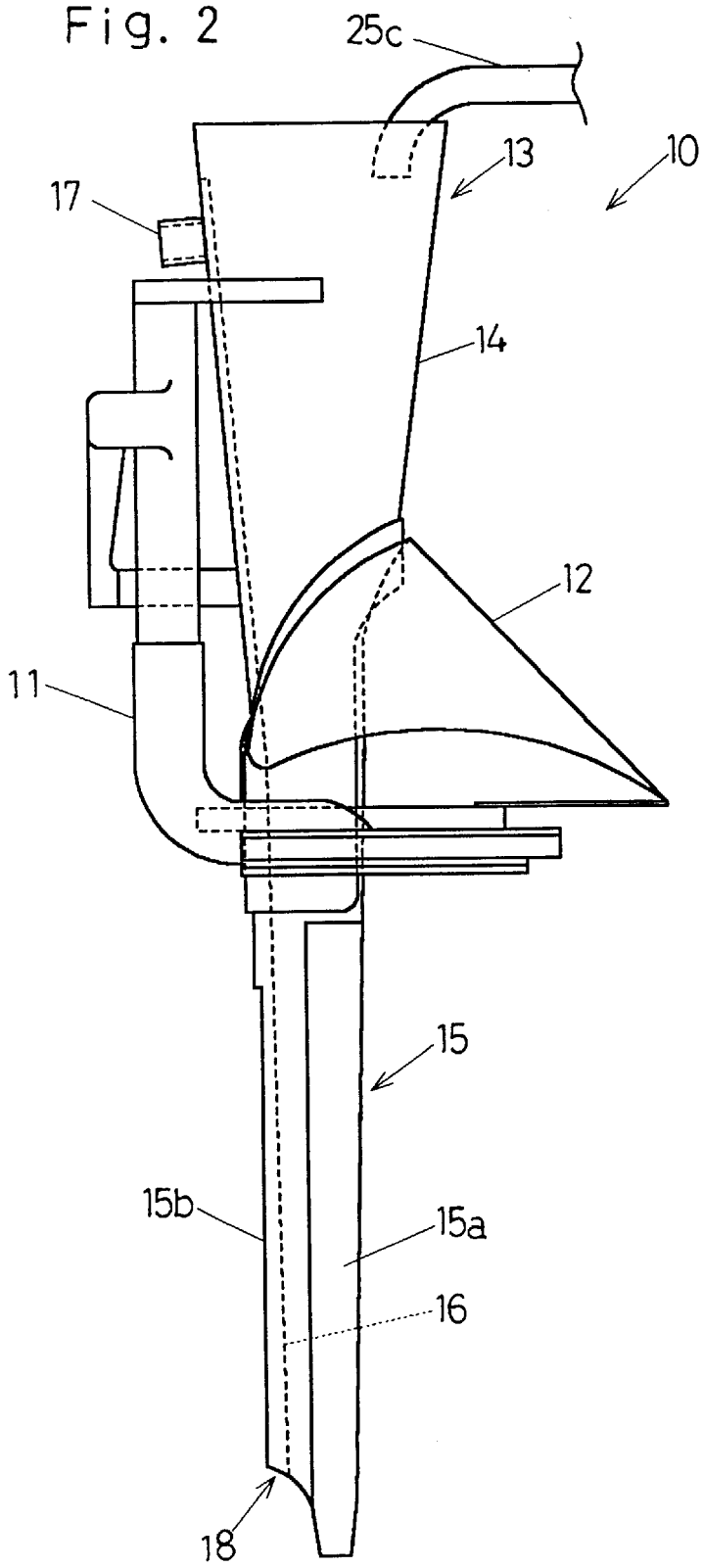
FIG. 2 is a schematic side view, on an enlarged scale, showing a bag former forming a part of the bagging and packaging machine shown in FIG. 1.

The bag former 10 of a unitary structure includes a frame 11 on which a sailor member 12 and a tube member 13 extending vertically through the sailor member 12 are mounted (See particularly FIG. 2). This bag former 10 is detachably mounted on a front upper surface of the base framework 2 and is so designed and so structured that as a strip of packaging material drawn outwardly from the roll of the packaging material can be guided downwards, opposite longitudinal side edges of the strip of packaging material can be overlapped with each other.

An upper portion 14 of the tube member 13 that protrudes upwards from the sailor member 12 is of a generally inverted conical shape having been upwardly flared to define a receiving opening into which articles to be bagged can be supplied from above. A lower portion 15 of the tube member 13 that protrudes downwards from the sailor member 12 is adapted to protrude into the packaging material, then formed into a tubular form, to supply the articles into the tubular packaging material.

On left and right sides of the lower portion 15 of the tube member 13, belt-type feeding devices 3 and 3 are disposed with their belts capable of running in a direction generally parallel to the direction of the feed of the tubular packaging material. These belt-type feeding devices 3 and 3 cooperate with the lower portion 15 of the tube member 13 so as to draw the tubular packaging material downwards in frictional contact with circumferentially opposite portions of the tubular packaging material that are then urged by the respective belts against correspondingly circumferentially opposite outer surface areas 15*a* and 15*a* of the lower portion 15 of the tube member 13. The overlapping side edges of the tubular packaging material that are so formed by the bag former 10 are, as the tubular packaging material is drawn downwards by the belt-type feeding devices 3 and 3 in the manner described above, fusion bonded together to form a longitudinally sealed tubular packaging material by means of a vertical sealing device 5 that is supported at the front of the base framework 2 by means of a support arm 4.

Somewhat beneath a lower end of the lower portion 15 of the tube member 13 and at the front of the base framework 2, there is disposed a transverse sealing device 6 capable of performing a sequential process of clamping the tubular packaging material, of which overlapping side edges have been sealed by the longitudinal sealing unit 5, that is, the longitudinally sealed tubular packaging material from front and rear directions to fuse a predetermined position of the longitudinally sealed tubular packaging material in a transverse direction perpendicular to the direction of feed of the packaging material, cutting the predetermined position of the longitudinally sealed tubular packaging material in the transverse direction to thereby leave a bottom seal in the longitudinally sealed tubular packaging material above the transverse cut line, and forming, after the articles have been filled in a portion of the longitudinally sealed packaging material above the bottom seal, a top seal thereby leaving a bagged product. A delivery device 7 for transporting the bagged product towards the subsequent processing station out of the bagging and packaging machine 1 is disposed under the transverse sealing device 6.

As best shown in FIG. 2, the bagging and packaging machine 1 is provided with a substitute gas supply passage 16 defined adjacent an inner surface of a front wall 15*b* of a tube member 13 for the supply of an inert gas into the article filled bag to substitute for the air within the article filled bag. More specifically, the substitute gas supply passage 16 is formed by securing a generally elongated plate 19, shown in FIG. 9, in spaced relation to the front wall 15*b* of the tube member 13 so as to extend generally vertically from the upper portion 14 of the tube member 13 down to the lower portion 15 thereof so as to leave a generally vertically elongated space between the elongated plate 19 and the front wall 15*d* of the tube member 13. The substitute gas passage 16 has an upper end closed by an upper end portion of the elongated plate 19 that is bent so as to extend towards a front wall of the upper portion 14 of the tube member 13 as shown in FIG. 2. A portion of the front wall of the upper portion 14 of the tube member 13 adjacent the closed upper end of the substitute gas passage 16 has a gas supply port 17 defined therein in communication with the substitute gas supply passage 16, and a gas supply piping 25 (See FIG. 3) is fluid-connected with the gas supply port 17. Also, the substitute gas supply passage 16 has a lower end left open to thereby define a gas outlet 18.

Figure 3:
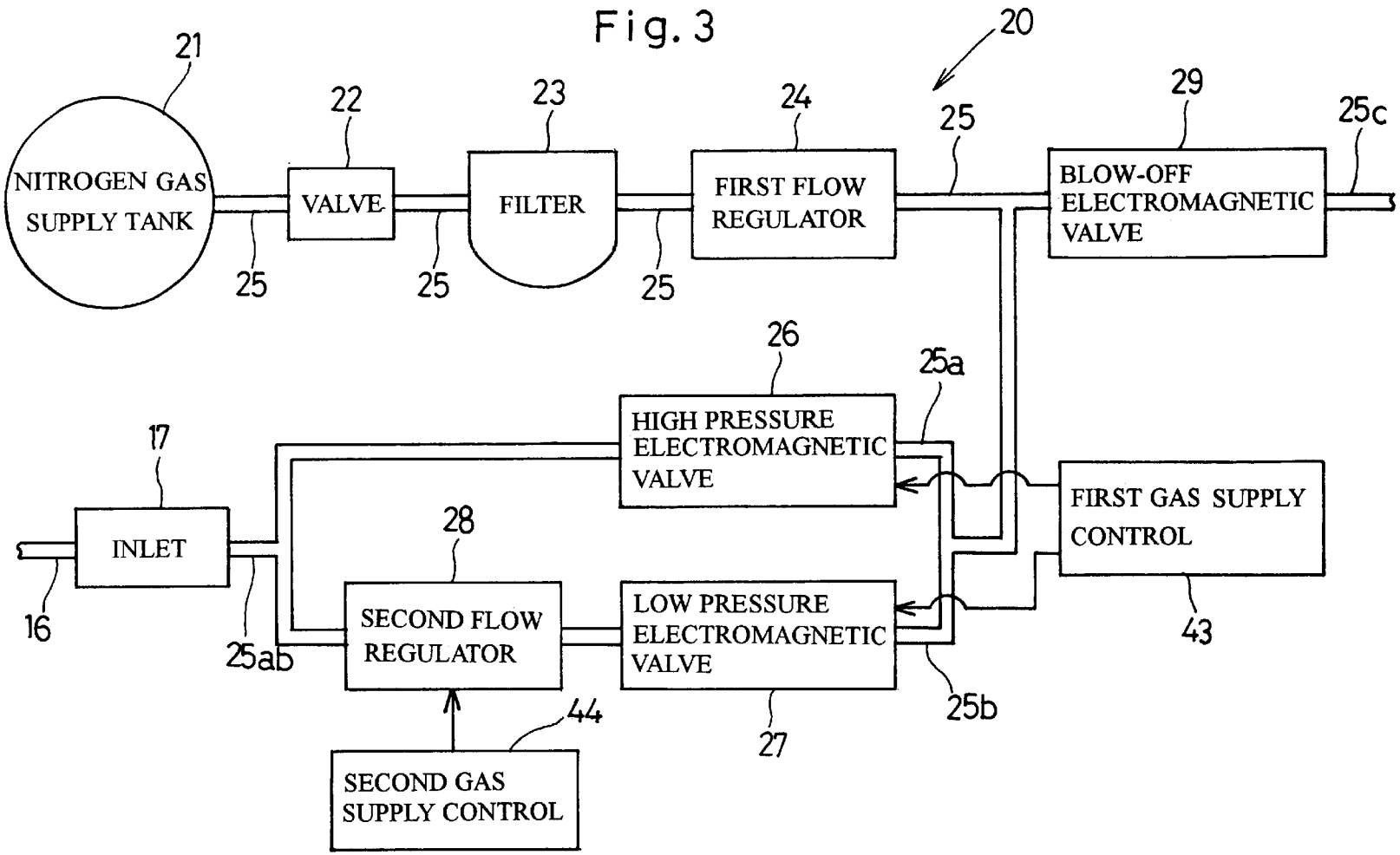
FIG. 3 is a block diagram showing a fluid circuit of a gas supply unit employed in the bagging and packaging machine of the present invention.

The bagging and packaging machine 1 also includes a gas supply unit 20 positioned external to the machine 1 for supplying the substitute gas, which may be an inert gas such as, for example, a nitrogen or argon gas, therefrom into the substitute gas passage 16 as shown in FIG. 3.

Referring now to FIG. 3, the gas supply unit 20 includes a nitrogen gas supply tank 21 containing a quantity of the inert gas, for example, nitrogen gas, a valve 22 for supplying the nitrogen gas downstream from the supply tank 21, a filter 23 for removing impurities contained in the nitrogen gas being supplied, and a first flow regulator 24 for controlling the flow of the nitrogen gas supplied through the filter 23 and also for measuring the flow rate of the nitrogen gas by a flow meter. The nitrogen gas supplied from the nitrogen gas supply tank 21 through the valve 22 is, after having passed through the filter 23 where the impurities are removed from the nitrogen gas, regulated by the first flow regulator 24 to a predetermined flow rate before the nitrogen gas is further supplied downstream.

The gas supply tank 21 is fluid connected through a supply pipe 25 with the valve 22 which is in turn fluid connected through a supply pipe 25 with the filter 23 which is also in turn fluid connected through a supply pipe 25 with the first flow regulator 24. A supply pipe 25 fluid connected with the first flow regulator 24 and extending downstream with respect to the direction of supply of the substitute gas is shunt to a high pressure supply pipe 25*a*, a low pressure supply pipe 25*b* and a blow-off supply pipe 25*c*. Of those supply pipes 25*a*, 25*b* and 25*c*, the high pressure supply pipe 25*a* and the low pressure supply pipe 25*b* are merged together to define a supply pipe 25*ab* that is fluid connected with the gas supply port 17 defined in the substitute gas passage 16. The blow-off supply pipe 25*c* has a downstream end fluid disposed within an upper open end of the tube member 13 so as to introduce the nitrogen gas into the interior of the tube member 13 as shown in FIG. 2.

A high pressure electromagnetic valve 26 is disposed on the high pressure supply pipe 25*a* for selectively initiating or interrupting the flow therethrough of the nitrogen gas supplied from the nitrogen gas supply tank 21. On the other hand, a low pressure electromagnetic valve 27 similar to the high pressure electromagnetic valve 26 is disposed on the low pressure supply pipe 25*b*. Selective energization or deenergization of each of those electromagnetic valves 26 and 27 is controlled by a first gas supply control means 43. It is to be noted that the low pressure electromagnetic valve 27 has its downstream side fluid connected with a second flow regulator 28 for controlling the flow rate of the nitrogen gas delivered from the low pressure electromagnetic valve 27, which second flow regulator 28 is equipped with a flow meter for measuring the flow rate of the nitrogen gas. Adjustment of the flow rate of the nitrogen gas that is accomplished by the second flow regulator 28 is carried out by a second gas supply control means 44 on the basis of the oxygen remaining rate as will be described in detail later. It is also to be noted that a blow-off electromagnetic valve 29 similar to any one of the high pressure electromagnetic valve 26 and the low pressure electromagnetic valve 27 is similarly disposed on the supply pipe 25*c* and that by controlling selective energization and deenergization of the blow-off electromagnetic valve 29, the nitrogen gas can be supplemented from the upper open end of the upper portion 14 of the tube member 13 into the interior of the tube member 13.

The gas supply control system employed in conjunction with the bagging and packaging machine 1 will now be described.

Figure 4:
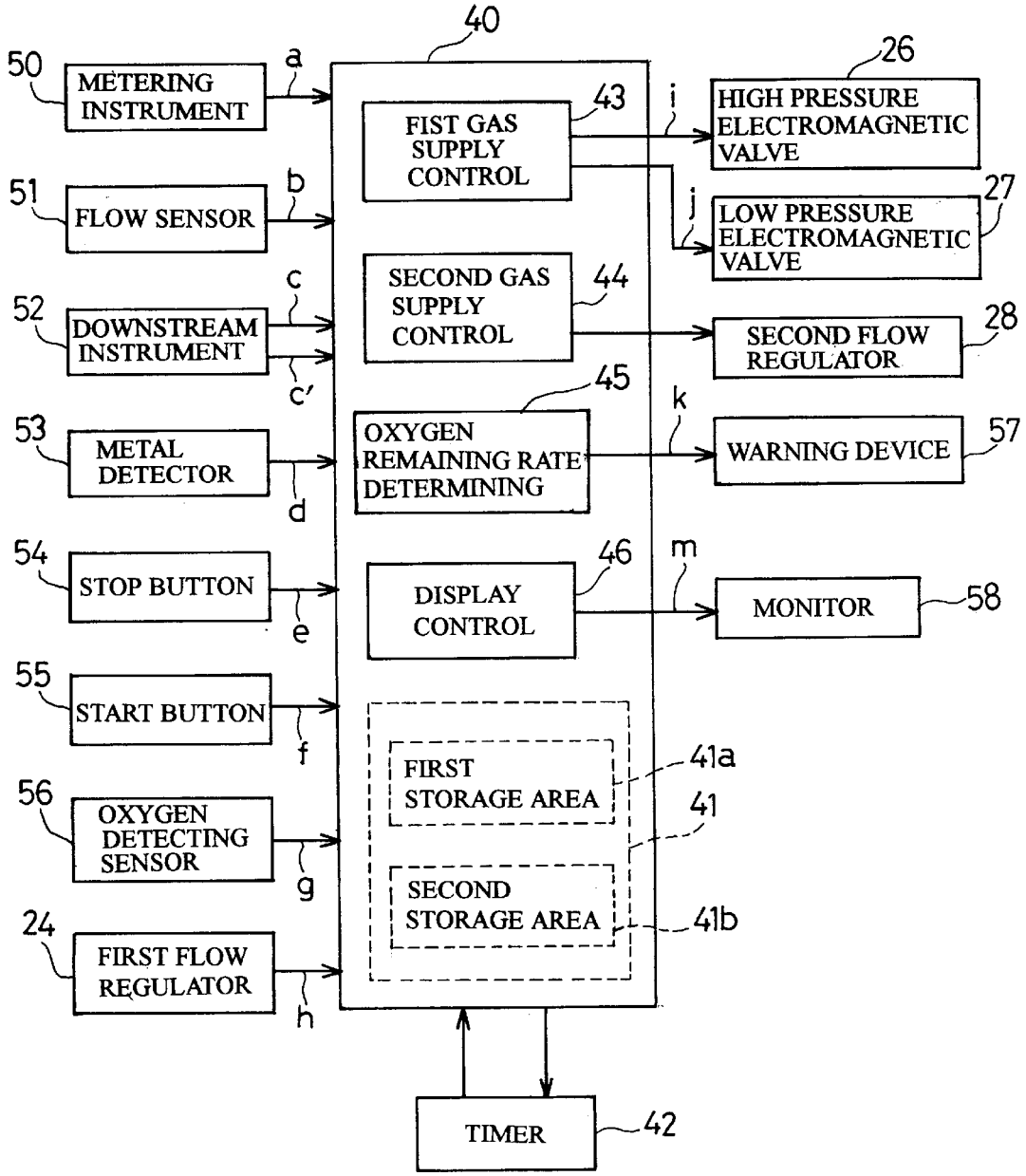
FIG. 4 is a block diagram showing a gas supply control system employed in conjunction with the bagging and packaging machine.

As shown in FIG. 4, the bagging and packaging machine 1 is provided with a control unit 40 including a memory device 41 built therein. This memory device 41 has a first storage area 41*a* in which the necessary oxygen remaining rate coordinated with properties of the bagged product is stored for each kind of the bagged products. The memory device 41 also has a second storage area 41*b* in which the current status of supply of the nitrogen gas and the oxygen remaining rate during operation of the bagging and packaging machine 1 can be stored.

The control unit 40 also includes, in addition to the first gas supply control means 43 and the second gas supply control means 44 both shown in FIG. 3, an oxygen remaining rate determining means 45 and a display control means 46 both as will be described in detail later. Based on time, a temporary interruption signal or a halt signal, the first gas supply control means 43 outputs control signals i and j, used to control opening and closure of the high pressure electromagnetic valve 26 and the low pressure electromagnetic valve 27, respectively, to such electromagnetic valves 26 and 27. The second gas supply control means 44 outputs a signal to the second flow regulator 28 to regulate the flow rate of the nitrogen gas.

The control unit 40 is adapted to receive the temporary interruption signal used to temporarily interrupt activation of the bagging and packaging machine 1 and the halt signal used to halt the activation of the bagging and packaging machine 1. It is, however, to be noted that the bagging and packaging machine 1 once interrupted temporarily can resume its normal operation when a factor for which the bagging and packaging machine is interrupted temporarily is removed, but the bagging and packaging machine 1 once halted will not resume its normal operation unless the attendant worker performs a starting procedure, that is, activate the bagging and packaging machine 1.

The temporary interruption signal includes an insufficient article signal a generated from a metering instrument 50 in the event that the article to be filled in each of the successively formed bags is short of a predetermined quantity or weight, a gas flow reduction signal b generated from a flow rate sensor 51 for detecting the flow rate of the nitrogen gas supplied from the nitrogen gas supply tank 21 in the event that the flow rate of the nitrogen gas decreases, a temporary interruption signal c generated from a downstream instrument 52 disposed downstream of the bagging and packaging machine 1, and others.

On the other hand, the halt signal includes a halt signal c' generated from the downstream instrument 52, a metal detection signal d generated from a metal detector 53 in the event that the metal detector 53 detects the presence of one or more metallic particles contained in the bagged product, a halt signal e generated from a stop button 54 manipulated by the attendant worker, and others.

The control unit 40 are also adapted to receive, other than the temporary interruption signal and the halt signal both discussed above, a start signal f generated from a start button 55 manipulated by the attendant worker when the bagging and packaging machine 1 is desired to be activated, a detection signal g generated from an oxygen detecting sensor 56 for detecting the amount of oxygen contained within each of the successively formed bags, a flow signal h generated from the flow meter built in the first flow regulator 24, and others.

When the insufficient article signal a, the gas flow reduction signal b, the temporary interruption signal c and the halt signal c' from the downstream instrument 52, the metal detection signal d, the stop signal e from the stop button 54, the start signal f and others are inputted to the control unit 40, a timer 42 provided external to the control unit 40 starts counting the length of time passing. Based on the length of time counted by the timer 42, the first gas supply control means 43 of the control unit 40 generates the control signals i and j to the high pressure electromagnetic valve 26 and the low pressure electromagnetic valve 27, respectively so that the electromagnetic valves can be selectively switched on and off in response to the associated control signals i and j.

Also, the second gas supply control means 44 of the control unit 40 also generates, in response to the detection signal g, a control signal with which the low pressure electromagnetic valve 27 can be finely adjusted.

In addition, in the event that the detection signal g is inputted to the control unit 40 and the oxygen remaining rate determining means 45 of the control unit 40 subsequently determines on the basis of the detection signal g that the amount of oxygen remaining within the bag with the article filled therein is greater than a predetermined amount, that is, the oxygen remaining rate increases, the oxygen remaining rate determining means 45 of the control unit 40 issues a warning signal k to a warning device 57 to cause the warning device 57 to generate a warning. In this way, the attendant worker can readily be acknowledged of the oxygen remaining rate then increasing and can, therefore, attend to dealing with the incident. Accordingly, it is possible to prevent the bagging and packaging machine 1 to continue production of the bagged products having an increased oxygen remaining rate.

The display control means 46 of the control unit 40 generates to a monitor display 58 a display signal m indicative of the operating condition of the bagging and packaging machine 1 and the condition of supply of the nitrogen gas from the gas supply unit 20 so that these conditions can be displayed through the monitor display 58. Looking at the monitor display 58, the attendant worker can come to know of the condition of supply of the nitrogen gas towards the bagging and packaging machine 1. It is to be noted that the condition of supply of the nitrogen gas may be represented by, for example, the amount of the nitrogen gas remaining within the nitrogen gas supply tank 21.

The control of the substitute gas supply executed in the bagging and packaging machine 1 embodying the present invention will now be described with particular reference to the flow chart shown in FIG. 5.

Figure 5:
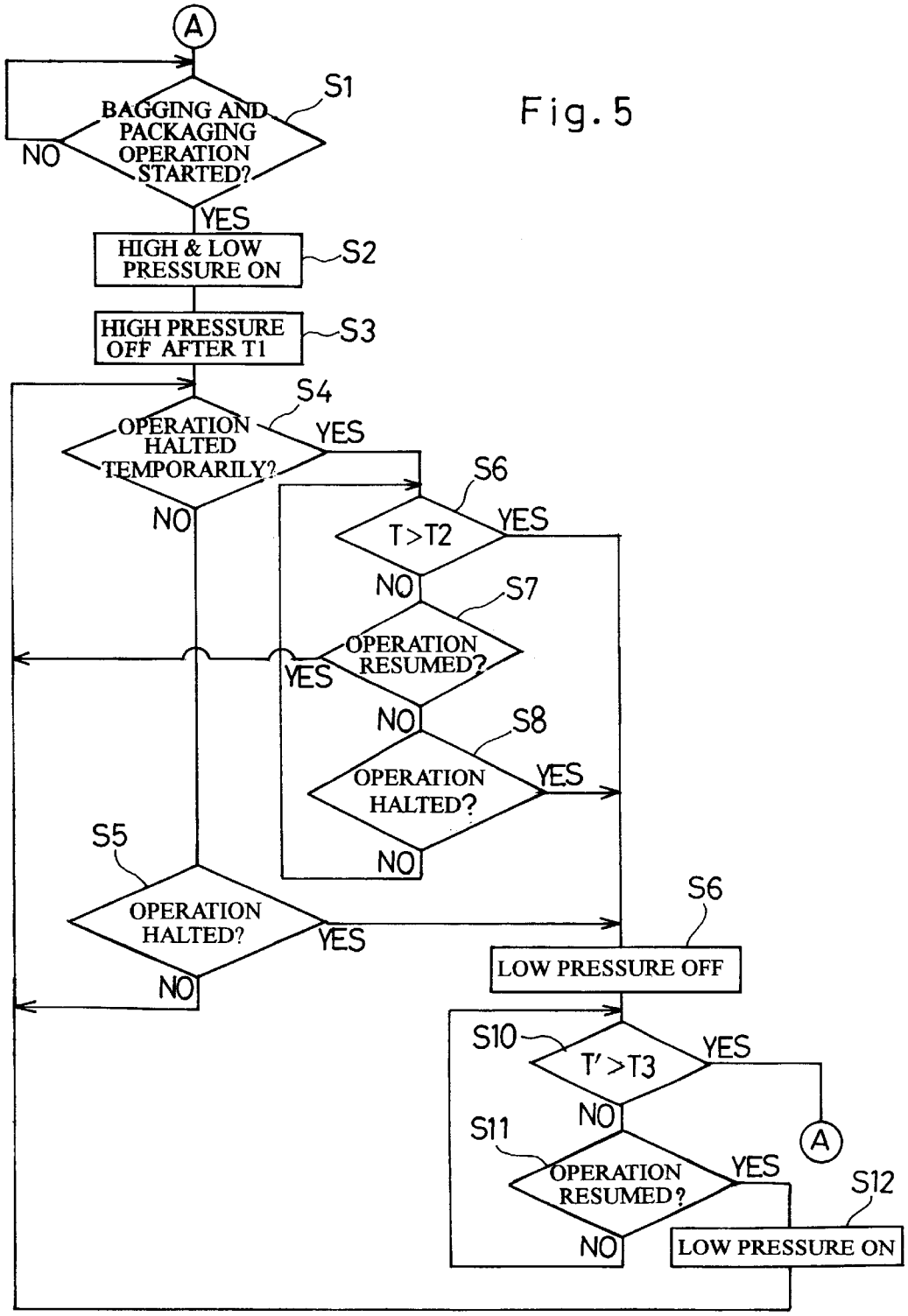
FIG. 5 is a flow chart showing the sequence of operation of the gas supply control system.

Referring to FIG. 5, and at step S1, the control unit 40 makes a decision of whether or not the bagging and packaging machine 1 is electrically powered on to run. This step S1 is repeated before the bagging and packaging machine 1 is powered on and, only when the bagging and packaging machine 1 is powered on to run, the first gas supply control means 43 of the control unit 40 causes the high pressure electromagnetic valve 26 and the low pressure electromagnetic valve 27 to be turned on at step S2 and at the same time the timer 42 is started. As a result, the nitrogen gas supplied from the nitrogen gas supply tank 21 is adjusted by the first flow regulator 24 to a predetermined gas flow rate which is in turn supplied to the gas supply port 17 defined in the substitute gas passage 16 through the high pressure electromagnetic valve 26 and the low pressure electromagnetic valve 27. At this time, the flow rate of the nitrogen gas supplied to the gas supply port 17 is adjusted to a high pressure flow rate L1 (See FIGS. 6 to 8).

When the length of time counted by the timer 42 that has been started at step S2 attains a high pressure gas supply time T1, the first gas supply control means 43 of the control unit 40 switches the high pressure electromagnetic valve 26 off at step S3. As a result thereof, the nitrogen gas supplied to the gas supply port 17 defined in the substitute gas supply passage 16 is adjusted by the second flow regulator 28 through the low pressure electromagnetic valve 27 to a low pressure flow rate L2 (See FIGS. 6 to 8) and is then supplied to the gas supply port 17. Accordingly, the nitrogen gas in the low pressure flow rate L2 is supplied into the bag into which the article is introduced. At this time, the length of time counted by the timer 42 once it has attained the high pressure gas supply time T1 is reset by the first gas supply control means 43.

Then, at step S4 the first gas supply control means 43 of the control unit 40 makes a decision of whether or not the temporary interruption signal is inputted to the control unit 40. In the event that no temporary interruption signal is inputted to the control unit 40, the program flow goes to step S5 at which a decision is made to determine whether or not the halt signal is inputted to the control unit 40. Where no halt signal is inputted to the control unit 40, the program flow returns to step S4.

When at step S4 the temporary interruption signal is inputted to the control unit 40, the length of time T passing subsequent to the timing at which the control unit 40 receives the temporary interruption signal is counted by the timer 42. After the timer 42 has counted the length of time T, and at step S6, the first gas supply control means 43 determines whether or not the length of time T has exceeded the low pressure gas supply time T2 which has been preset.

Before the length of time T exceeds the low pressure gas supply time T2, the first gas supply control means 43 determines at step S7 whether or not the inputting of the temporary interruption signal to the control unit 40 is released. In the event that the inputting of the temporary interruption signal is not released, the first gas supply control means 43 again determines at step S8 whether or not the halt signal is inputted to the control unit 40. In the event that no halt signal is inputted to the control unit 40, the program flow returns to step S6.

However, where as determined at step S7 the inputting of the temporary interruption signal is released, the timer 42 is reset by the first gas supply control means 43 and the program flow returns to step S4.

Accordingly, even when the temporary interruption signal is inputted to the control unit 40, the low pressure electromagnetic valve 27 is held in an ON state before the length of time T counted by the timer 42 exceeds the predetermined low pressure gas supply time T2 and, consequently, the nitrogen gas continues to be supplied at the flow rate L2 to the bagging and packaging machine 1.

In the event that as determined at step S6 the length of time T counted by the timer 41 exceeds the predetermined low pressure gas supply time T2, or when the halt signal is inputted to the control unit 40 at step S5 or when the halt signal is inputted to the control unit 40 at step S8, the first gas supply control means 43 of the control unit 40 switches the low pressure electromagnetic valve 27 off at step S9. Hence, the supply of the nitrogen gas to the bagging and packaging machine 1 is completely halted.

From the moment the low pressure electromagnetic valve 27 is switched off, another length of time T' passing is counted by the timer 42. Then, at step S10, the first gas supply control means 43 determines whether or not the length of time T' exceeds the predetermined low pressure gas supply wait time T3. Should the length of time T' have exceeded the predetermined low pressure gas supply wait time T3, the program flow returns to step S1, but should it have not exceeded the predetermined low pressure gas supply wait time T3, the program flow goes to step S11 at which the first gas supply control means 43 determines whether or not the bagging and packaging machine 1 is re-started.

In the event that the bagging and packaging machine 1 has not yet been activated, the program flow returns to step S10, but in the event that the bagging and packaging machine 1 has been activated, the first gas supply control means 43 of the control unit 40 switches the low pressure electromagnetic valve 27 on at step S12, thereby repeating the program flow from step S4 onwards. As a result, the nitrogen gas is again supplied at the flow rate L2 to the bagging and packaging machine 1.

Figure 6:
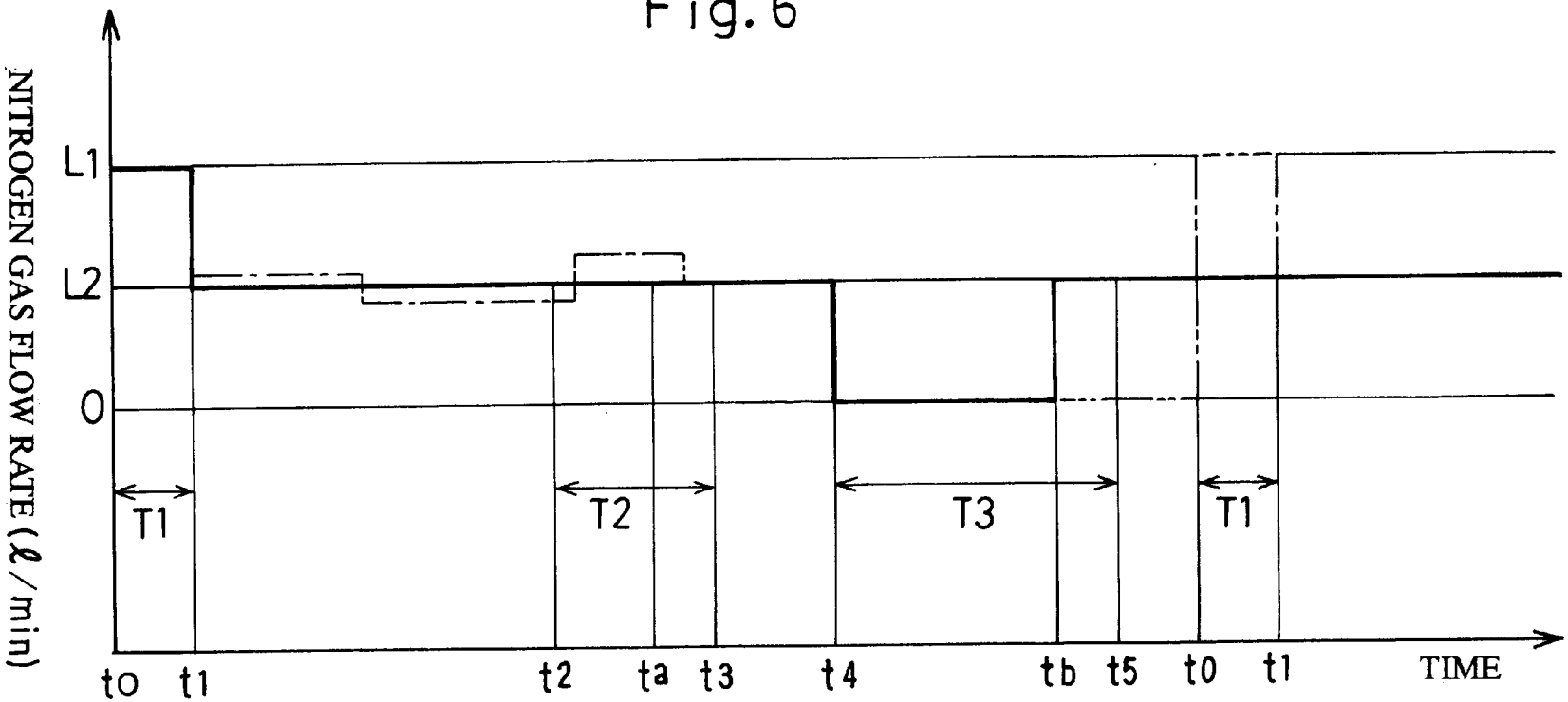
FIG. 6 is a timing chart showing change in supply of an inert gas effected by the gas supply control system.

Referring to the timing chart shown in FIG. 6, when the bagging and packaging machine 1 is activated, that is, at the timing t0 at which the high pressure gas supply is initiated, the timer 42 starts counting the length of time and, at the same time, the high pressure electromagnetic valve 26 and the low pressure electromagnetic valve 27 are switched on, allowing the nitrogen gas to be supplied under a high pressure at the flow rate L1 to the gas supply port 17 disposed in the substitute gas passage 16.

Then, when the count of the timer 42 attains the length of time T1, that is, at the timing t1 at which the high pressure gas supply is halted, the timer 42 is reset and, at the same time, the high pressure electromagnetic valve 26 is switched off, thereby allowing the nitrogen gas, supplied to the gas supply port 17 in the substitute gas passage 16, to flow through the second flow regulator 28 by way of the low pressure electromagnetic valve 27. Hence, the nitrogen gas emerging from the second flow regulator is supplied under a low pressure at the flow rate L2 towards the gas supply port 17 and then into the bag filled with the article.

When the bagging and packaging machine 1 is temporarily brought to a halt, the timer 42 starts counting the length of time passing from the timing t2 at which the machine 1 is temporarily brought to a halt, but the supply of the nitrogen gas continues at the low pressure flow rate L2 to the bagging and packaging machine 1. When the bagging and packaging machine once halted temporarily resumes its operation by the automatic stop timing t3 that occurs the low pressure gas supply time T2 after the temporarily halted timing t2, the timer 42 is reset at the timing ta at which the temporary halt of the bagging and packaging machine 1 is released, and the supply of the nitrogen gas continues at the low pressure flow rate L2 to the bagging and packaging machine 1.

Thereafter, the timer 42 starts counting the length of time at the timing the bagging and packaging machine 1 is brought to a halt, that is, the timing t4 at which the supply of the nitrogen gas is interrupted, and the low pressure electromagnetic valve 27 is switched off at the gas supply interrupting timing t4. In other words, the supply of the nitrogen gas to the bagging and packaging machine 1 is completely interrupted.

When the bagging and packaging machine 1 is again started by the timing t5 at which the supply of the nitrogen gas under a low pressure is resumed, which occurs the low gas supply wait time T3 subsequent to the gas supply interrupting timing t4, the timer 42 is reset and the low pressure electromagnetic valve 27 is switched on at the low pressure gas supply resuming timing tb. As a result thereof, the nitrogen gas is again supplied under the low pressure at the flow rate L2 to the bagging and packaging machine 1. It is to be noted that where the bagging and packaging machine 1 is started at a timing past the low pressure gas supply resuming timing t5, the nitrogen gas can be supplied under a high pressure at the flow rate L1 to the bagging and packaging machine 1 as shown by the phantom line. The reason for the supply of the nitrogen gas under the high pressure at the flow rate L1 to the bagging and packaging machine 1 in this manner is because if the bagging and packaging machine 1 is started at the timing past the low pressure gas supply resuming timing t5, the replacement rate of the gas within the bag is lowered and, therefore, a relatively large quantity of the nitrogen gas has to be supplied into the bag.

Figure 7:
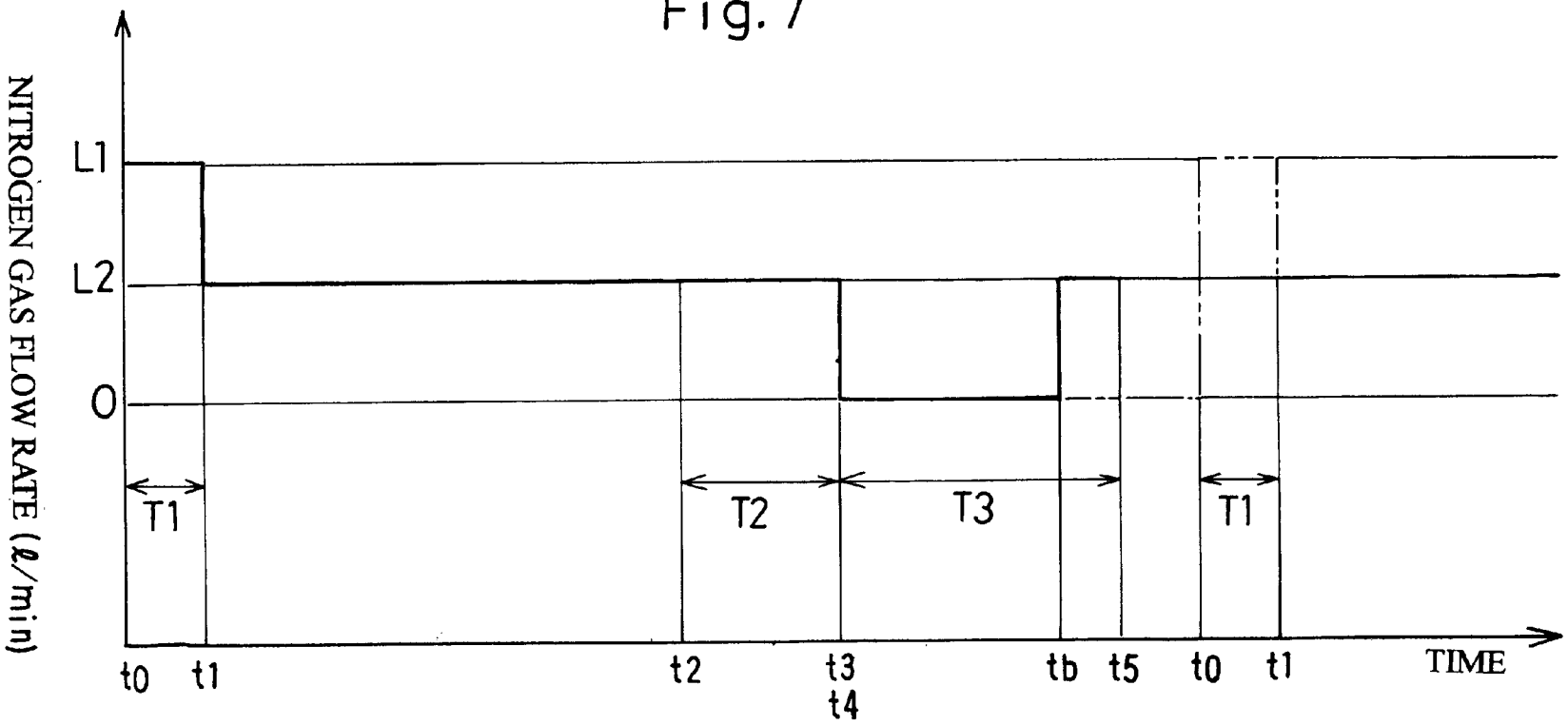
FIG. 7 is a timing chart showing change in supply of an inert gas effected by the gas supply control system.

In the next place, the timing chart shown in FIG. 7 will now be discussed. Referring to FIG. 7, when the bagging and packaging machine is activated, that is, at the timing t0 at which the supply of the nitrogen gas under high pressure is initiated, the timer 42 starts counting the length of time and, at the same time, the high pressure electromagnetic valve 26 and the low pressure electromagnetic valve 27 are switched on to allow the nitrogen gas to be supplied under a high pressure at the flow rate L1 to the gas supply port 17 in the substitute gas passage 16.

When the count of the timer 42 subsequently attains the length of time T1, that is, at the timing t1 at which the high pressure gas supply is halted, the timer 42 is reset and, at the same time, the high pressure electromagnetic valve 26 is switched off, thereby allowing the nitrogen gas, supplied to the gas supply port 17 in the substitute gas passage 16, to flow through the second flow regulator 28 by way of the low pressure electromagnetic valve 27. Hence, the nitrogen gas emerging from the second flow regulator is supplied under a low pressure at the flow rate L2 towards the gas supply port 17 and then into the bag filled with the article.

When the bagging and packaging machine 1 is temporarily brought to a halt, the timer 42 starts counting the length of time passing from the timing t2 at which the machine 1 is temporarily brought to a halt, but the supply of the nitrogen gas continues at the low pressure flow rate L2 to the bagging and packaging machine 1. The bagging and packaging machine is automatically halted at the automatic stop timing t3 that occurs the low pressure gas supply time T2 after the temporarily halted timing t2 and, at the same time, the timer 42 is reset. Also, the timer 42 starts counting the length of time from the gas supply interrupting timing t4 which is the same timing as the timing at which the bagging and packaging machine 1 is halted, that is, the automatic stop timing t3 and, at the timing t4, the low pressure electromagnetic valve 27 is switched off. Thus, the supply of the nitrogen gas to the bagging and packaging machine 1 is completely interrupted.

When the bagging and packaging machine 1 is again started by the timing t5 at which the supply of the nitrogen gas under a low pressure is resumed, which occurs the low pressure gas supply wait time T3 subsequent to the gas supply interrupting timing t4, the timer 42 is reset and, at the same time, the low pressure electromagnetic valve 27 is switched on at the low pressure gas supply resuming timing tb at which the bagging and packaging machine 1 has resumed its operation. As a result thereof, the nitrogen gas is supplied under the low pressure at the flow rate L2 to the bagging and packaging machine 1. It is, however, to be noted that where the bagging and packaging machine is started at a timing past the low pressure gas supply resuming timing t5, the nitrogen gas can be supplied under a high pressure at the flow rate L1 to the bagging and packaging machine 1 as shown by the phantom line.

Figure 8:
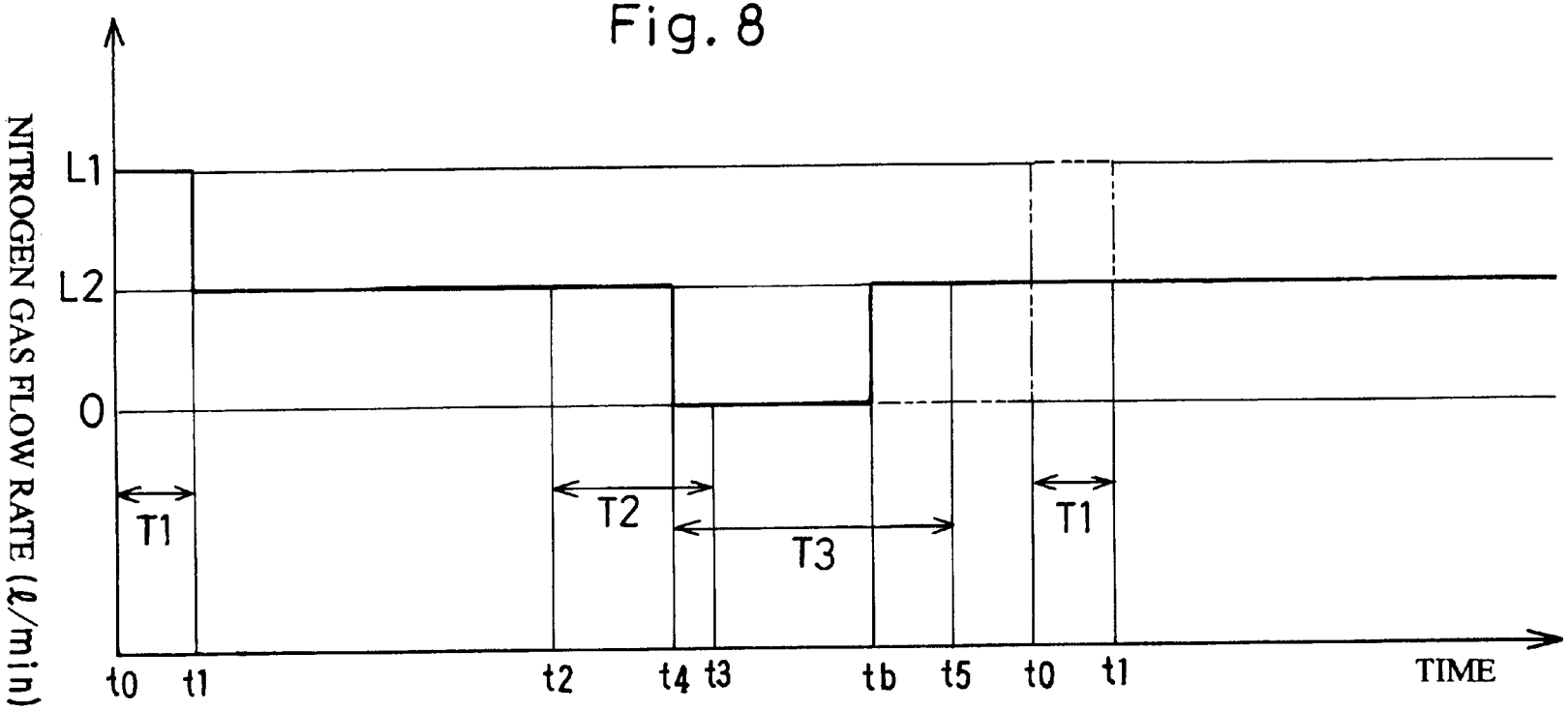
FIG. 8 is a timing chart showing change in supply of an inert gas effected by the gas supply control system.

The timing chart shown in FIG. 8 will now be discussed. Referring to FIG. 8, when the bagging and packaging machine is activated, that is, at the high pressure gas supply start timing t0, the timer 42 starts counting the length of time and, at the same time, the high pressure electromagnetic valve 26 and the low pressure electromagnetic valve 27 are switched on to allow the nitrogen gas to be supplied under a high pressure at the flow rate L1 to the gas supply port 17 in the substitute gas passage 16.

When the count of the timer 42 subsequently attains the length of time T1, that is, at the high pressure gas supply interruption timing t1, the timer 42 is reset and, at the same time, the high pressure electromagnetic valve 26 is switched off, thereby allowing the nitrogen gas, supplied to the gas supply port 17 in the substitute gas passage 16, to flow through the second flow regulator 28 by way of the low pressure electromagnetic valve 27. Hence, the nitrogen gas emerging from the second flow regulator is supplied under a low pressure at the flow rate L2 towards the gas supply port 17 and then into the bag filled with the article.

When the bagging and packaging machine 1 is temporarily brought to a halt, the timer 42 starts counting the length of time passing from the timing t2 at which the machine 1 is temporarily brought to a halt, but the supply of the nitrogen gas continues at the low pressure flow rate L2 to the bagging and packaging machine 1. When the bagging and packaging machine is automatically halted before the automatic stop timing t3 that occurs the low pressure gas supply time T2 after the temporarily halted timing t2, at the timing the bagging and packaging machine I is halted, that is, at the gas supply interrupting timing t4 the timer 42 is reset and starts counting the length of time, and at the gas supply interrupting timing t4 the low pressure electromagnetic valve 27 is switched off. Thus, the supply of the nitrogen gas to the bagging and packaging machine 1 is completely interrupted.

When the bagging and packaging machine 1 is again started by the timing t5 at which the supply of the nitrogen gas under a low pressure is resumed, which occurs the low pressure gas supply wait time t3 subsequent to the gas supply interrupting timing t4, the timer 42 is reset and, at the same time, the low pressure electromagnetic valve 27 is switched on at the low pressure gas supply resuming timing tb at which the bagging and packaging machine 1 has resumed its operation. As a result thereof, the nitrogen gas is supplied under the low pressure at the flow rate L2 to the bagging and packaging machine 1. It is, however, to be noted that where the bagging and packaging machine is started at a timing past the low pressure gas supply resuming timing t5, the nitrogen gas can be supplied under a high pressure at the flow rate L1 to the bagging and packaging machine 1 as shown by the phantom line.

Hereinafter, the operation of the inert gas supply system according to the foregoing embodiment will be described.

Figure 9:
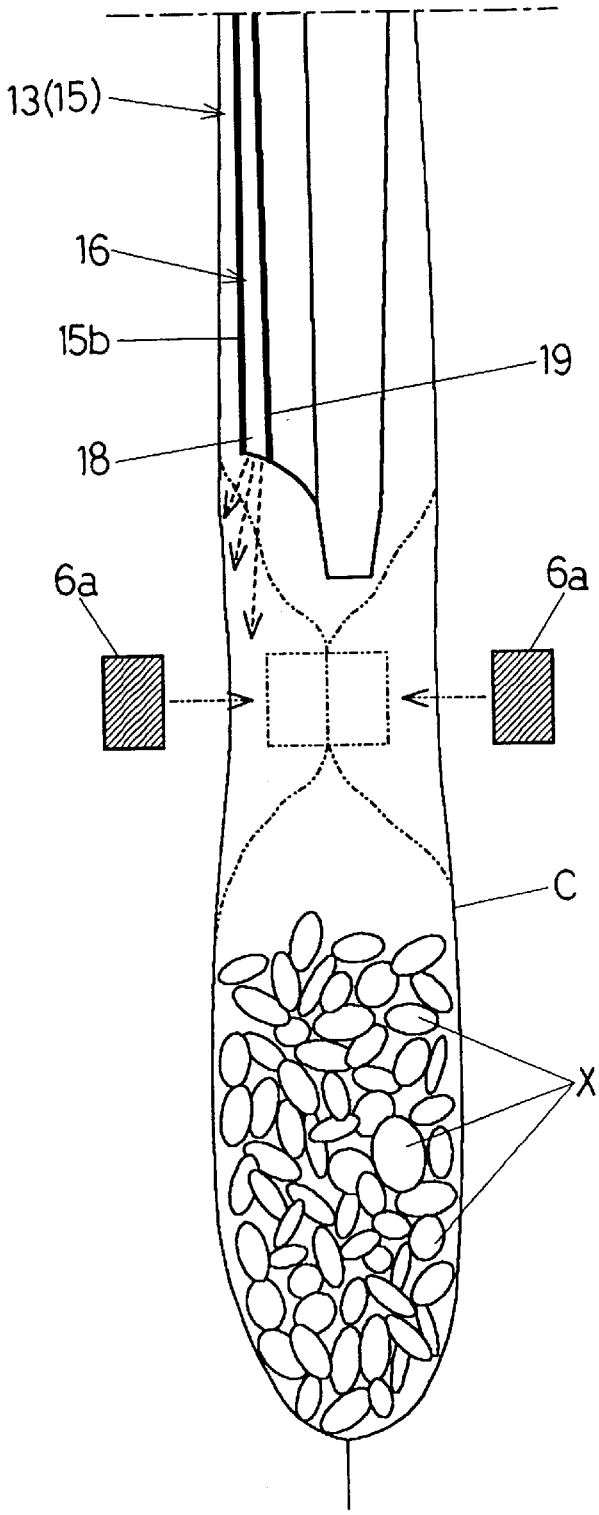
FIG. 9 is a schematic diagram illustrating the manner of introduction of the inert gas into a bag through a lower end of a tube member.

At the outset the bagging and packaging machine 1 is electrically powered, and the strip of bag material is drawn forwards from the roll support disposed at the rear of the base framework 2 so as to travel downwards from a front upper portion of the base framework 2 so that the opposite longitudinal side edges of the strip of bag material can be turned to overlap one above the other by means of the sailor member 12 forming a part of the bag former 10 with that portion of the strip of bag material consequently shaped into a tubular form. During the continued feed of the strip of bag material downwards by means of the belt-type feeding devices 3 and 3, the overlapped longitudinal side edges of the tubular strip of bag material is sealed by the longitudinal sealing unit 5 at a location adjacent an outer surface of the front wall of the lower portion 15 of the tube member 13, thereby forming a bag C (FIG. 9). At this time, a lower portion of the tubular strip of bag material was sealed by a transverse sealing device 6 during the previous cycle of bag forming operation. After the bag C so formed is further moved downwards, articles X . . . X are filled into the bag C from above through the tube member 13.

Also, simultaneously or substantially simultaneously with the filling of the articles X . . . X into the bag C, the nitrogen gas is supplied into the bag C from the gas supply means 20 through the substitute gas passage 16 to substitute for the air within the bag C, which air is purged to the outside through the upper end of the tube member 13 and an open bent portion of the tubular strip of bag material formed by the sailor member 12. In this way, the air within the bag filled with the articles X . . . X is replace with the nitrogen gas. Since the oxygen remaining rate appropriate to the characteristics of the bagged product for each kind of bagged products is stored in the first storage area 41*a* of the memory device 41, the stored oxygen remaining rate is read out from the first storage area 41*a* of the memory device 41 and is used by the second gas supply control means 44 to supply the nitrogen gas from the gas supply unit 20 in a quantity sufficient to allow the oxygen remaining rate within the bag C to attain a value generally or substantially equal to the stored oxygen remaining rate. An example of the control of the supply of the nitrogen gas based on the oxygen remaining rate is shown by the chain line in FIG. 6. This control is finely adjusted with reference to the nitrogen gas flow rate L2 taken as a reference.

As described above, the supply of the nitrogen gas from the gas supply unit into each of the successively formed bags C is thus controlled. Specifically, at the start of the bagging and packaging operation performed by the bagging and packaging machine 1, the nitrogen gas supplied from the gas supply unit 20 is supplied at the high pressure flow rate L1 into each bag C. At this time, to avoid any possible blow-up of some of the articles X . . . X within the respective bag C, no articles is introduced into the bag C during a period in which the nitrogen gas is supplied at the high pressure flow rate L1.

After the predetermined time T1, the flow rate of the nitrogen gas is adjusted from the high pressure flow rate L1 to the low pressure flow rate L2 and, at the same time, the articles X . . . X are introduced into the bag C. It is to be noted that the low pressure flow rate L2 is of a value so chosen and so adjusted that no blow-up of the articles X . . . X will not substantially occur within the bag. Even so, a relatively high gas replacement rate can be attained. Also, the low pressure flow rate L2 is, however, set depending on the weight and the shape of the bag and is of a value appropriate to the type or kind of the articles to be bagged.

Thereafter, the bag with the articles X . . . X filled therein is heat-sealed by a pair of bar members 6*a* and 6*a* of the transverse sealing device 6 at an upstream location above the filled articles X . . . X within the bag C and is then separated from the strip of bag material. The bag C with the articles X . . . X filled therein is subsequently falls onto the delivery device 7. It is to be noted that the upstream portion of the bag C with the articles X . . . X filled therein that is cut to separate the filled bag C from the strip of bag material defines a bottom seal for the subsequently formed bag in readiness for the subsequent filling of the articles thereinto.

In this way, the bagged products each comprised of a bag having a predetermined quantity of articles filled therein and also with the inert gas filled therein are successively manufactured and are delivered out of the bagging and packaging machine 1 through the delivery device 7.

On the other hand, in the event that the bagging and packaging machine 1 is temporarily halted while the articles X . . . X are being bagged and packaged by the bagging and packaging machine 1, the gas supply unit 20 continues supplying the nitrogen gas under low pressure at the flow rate L2 into the bag C for a predetermined length of time. Accordingly, since the oxygen remaining rate within the bag C is not increased when the bagging and packaging machine 1 resumes its normal operation within the predetermined length of time, the bagged products each having the oxygen remaining rate controlled down to a predetermined value can be obtained with no need to interrupt the bagging and packaging operation.

Also, after the lapse of a predetermined length of time subsequent to the temporary halt of the bagging and packaging machine 1, the bagging and packaging machine 1 is brought to a halt and the gas supply unit 20 completely interrupts the supply of the nitrogen gas towards the bagging and packaging machine 1. Accordingly, the amount of the gas supplied from the gas supply unit 20 will not increase unnecessarily.

Moreover, in the event that the bagging and packaging machine 1 resumes its normal operation within the predetermined length of time subsequent to the halt of the bagging and packaging machine 1, the nitrogen gas can be again supplied under low pressure at the flow rate L2 into the bag C. Accordingly, not only can the amount of the gas supplied from the gas supplied unit 20 be suppressed advantageously, but the bagged products each having the oxygen remaining rate controlled down to a predetermined value can be obtained.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A bagging and packaging machine for forming a bag from a strip of bag material and introducing an article into the bag, said bagging and packaging machine comprising:

a gas supply means for supplying an inert gas into the bag to substitute for air contained in the bag; and a first gas supply control means for controlling supply of the inert gas by the gas supply means into the bag;

said first gas supply control means being operable to effect supply of the inert gas into the bag at a first flow rate for a predetermined length of time subsequent to start of operation of the bagging and packaging machine to thereby increase a gas replacement rate and at a second flow rate lower than the first flow rate subsequent to elapse of the predetermined length of time, such that an amount of the inert gas consumed within the bag is counterbalanced with an amount of the inert gas supplied into the bag;

wherein said bagging and packaging machine is operable to introduce articles into multiple bags formed and filled in a series; and wherein said second, lower flow rate continues while articles are introduced into a plurality of bags formed and filled sequentially in the series.

2. The bagging and packaging machine as claimed in claim 1, wherein the first gas supply control means continues supply of the inert gas into the bag for a second predetermined length of time subsequent to a temporary halt of the bagging and packaging machine, in a quantity sufficient to avoid reduction of the gas replacement rate within the bag.

3. The bagging and packaging machine as claimed in claim 1, further comprising a display means for providing a visual indication of a status of supply of the inert gas from the gas supply means.

4. The bagging and packaging machine as claimed in claim 1, further comprising a storage means for storing a status of supply of the inert gas from the gas supply means or an oxygen remaining rate during operation of the bagging and packaging machine.

5. The bagging and packaging machine as claimed in claim 1, wherein the first gas supply control means includes electronic means operable to effect supply of the inert gas into the bag at the first flow rate for a predetermined length of time in response to an electrical signal indicative of the start of operation of the bagging and packaging machine, and at the second flow rate lower than the first flow rate subsequent to elapse of the predetermined length of time.

6. A bagging and packaging machine for forming a bag from a strip of bag material and introducing an article into the bag, said bagging and packaging machine comprising:

a gas supply means for supplying an inert gas into the bag to substitute for air contained in the bag; and a first gas supply control means for controlling supply of the inert gas by the gas supply means into the bag;

said first gas supply control means being operable to continue the supply of the inert gas into the bag for a predetermined length of time subsequent to a temporary halt of the bagging and packaging machine's normal bagging and packaging operations, in a quantity sufficient to avoid reduction of the gas replacement rate within the bag.

7. The bagging and packaging machine as claimed in claim 6, further comprising a display means for providing a visual indication of a status of supply of the inert gas from the gas supply means.

8. The bagging and packaging machine as claimed in claim 6, further comprising a storage means for storing a status of supply of the inert gas from the gas supply means or an oxygen remaining rate during operation of the bagging and packaging machine.

9. The bagging and packaging machine as claimed in claim 6, wherein the first gas supply control means includes electronic means operable to continue the supply of the inert gas into the bag for the predetermined length of time in response to an electrical signal indicative of the temporary halt of the bagging and packaging machine, and to halt the supply of the inert gas after the predetermined length of time.

10. A packaging machine operable to package articles into an article container, the packaging machine comprising:

a gas supply operable to supply a gas into the container to substitute for air contained in the container; and a gas supply controller operable to control the supply of the gas from the gas supply into the container;

wherein the gas supply controller is operable to effect supply of the gas into the container at a first flow rate for a time subsequent to a start of operation of the packaging machine and at a second flow rate lower than the first flow rate after that time and during the machine's packaging operation;

wherein said packaging machine is operable to package articles into multiple containers in a series;

wherein said second, lower flow rate continues while articles are introduced into a plurality of containers of the series;

wherein the gas supply comprises a high pressure valve and a low pressure valve; and wherein the gas supply controller is operable to effect supply of gas through the high pressure valve for the time subsequent to the start of operation of the packaging machine and through the low pressure valve after that time.

11. The packaging machine of claim 10:

wherein the gas supply controller is operable to effect supply of gas through both the high pressure valve and the low pressure valve for the time subsequent to the start of operation of the packaging machine, and through the low pressure valve and not through the high pressure valve, after that time.

12. A packaging machine operable to package articles into an article container, the packaging machine comprising:

a gas supply operable to supply a gas into the container to substitute for air in the container; and a gas supply controller operable to control the supply of the gas from the gas supply into the container;

wherein the gas supply controller is operable to continue supply of the gas into the container for a predetermined period of time after a temporary halt of the machine's normal packaging operation, wherein the gas supply comprises a high pressure valve and a low pressure valve; and wherein the gas supply controller is operable to continue supply of the gas through the low pressure valve into the container for a predetermined period of time after a temporary halt of the machine's packaging operation.

13. A packaging machine operable to package articles into an article container, the packaging machine comprising:

a gas supply operable to supply a gas into the container to substitute for air in the container;

a gas supply controller operable to control the supply of the gas from the gas supply into the container;

wherein the gas supply controller is operable to continue supply of the gas into the container for a predetermined period of time after a temporary halt of the machine's normal packaging operation, wherein the gas supply comprises a high pressure valve and a low pressure valve;

wherein the gas supply controller is operable to continue supply of the gas through the low pressure valve into the container for a predetermined period of time after a temporary halt of the machine's packaging operation;

wherein the gas supply controller is operable to continue supply of the gas into the container, through the low pressure valve and not through the high pressure valve, for a predetermined period of time after a temporary halt of the machine's packaging operation.

14. A packaging machine operable to package articles into an article container, the packaging machine comprising:

a gas supply operable to supply a gas into the container to substitute for air in the container; and a gas supply controller operable to control the supply of the gas from the gas supply into the container;

wherein the gas supply controller is operable to continue supply of the gas into the container for a predetermined period of time after a temporary halt of the machine's normal packaging operation wherein the gas supply comprises a high pressure valve and a low pressure valve; and wherein the gas supply controller is operable to supply the gas into the container through the low pressure valve and the high pressure valve for a time prior to a start of the machine's packaging operation, and though the low pressure valve and not through the high pressure valve after the time prior to the start of the machine's packaging operation.

* * * * *